US011313253B2

(12) United States Patent
Van Wingerden et al.

(10) Patent No.: US 11,313,253 B2
(45) Date of Patent: Apr. 26, 2022

(54) CENTER PIVOT LATCHED DEACTIVATING ROCKER ARM

(71) Applicant: Eaton Intelligent Power Limited, Dublin (IE)

(72) Inventors: Mark Van Wingerden, Battle Creek, MI (US); Ryan Krieger, Portage, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/262,819

(22) PCT Filed: Jul. 26, 2019

(86) PCT No.: PCT/EP2019/025251
§ 371 (c)(1),
(2) Date: Jan. 25, 2021

(87) PCT Pub. No.: WO2020/020492
PCT Pub. Date: Jan. 30, 2020

(65) Prior Publication Data

US 2021/0310379 A1 Oct. 7, 2021

Related U.S. Application Data

(60) Provisional application No. 62/841,175, filed on Apr. 30, 2019, provisional application No. 62/711,200, filed on Jul. 27, 2018.

(51) Int. Cl.
*F01L 1/18* (2006.01)
*F01L 13/00* (2006.01)
*F01L 1/46* (2006.01)

(52) U.S. Cl.
CPC ..... *F01L 1/181* (2013.01); *F01L 13/0005* (2013.01); *F01L 2001/186* (2013.01);
(Continued)

(58) Field of Classification Search
CPC ..... F01L 1/181; F01L 2001/186; F01L 2001/467; F01L 13/0005
(Continued)

(56) References Cited

U.S. PATENT DOCUMENTS 5,577,469 A * 11/1996 Muller ..... F01L 1/181 123/90.16
11,136,906 B2 10/2021 Van Wingerden et al.
(Continued)

FOREIGN PATENT DOCUMENTS

EP 2578820 A1 4/2013
EP 3170997 A1 5/2017
(Continued)

OTHER PUBLICATIONS

International Search Report and Written Opinion for PCT/EP2019/025251; dated Oct. 21, 2019; pp. 1-12.

*Primary Examiner* — Jorge L Leon, Jr.
(74) *Attorney, Agent, or Firm* — Mei & Mark, LLP

(57) ABSTRACT

A rocker arm can comprise a cam arm, a valve arm, a lost motion spring, and a pair of deactivatable latches configured to impede travel of the cam arm with respect to the lost motion spring and configured to enable the cam arm to collapse the lost motion spring. The cam arm can comprise a cam interface, a spring pressing area, a cam arm body, and a pivot axle connection. The valve arm can comprise a valve arm body, a rocker shaft bore, a latch socket, and lost motion spring mount. A pivot axle can connect the valve arm body to the cam arm body. Alternatively, a latch socket in a valve arm neck comprises a latch assembly whereby a deactivatable latch is configured to impede motion of the cam arm and to collapse so the cam arm can collapse the lost motion spring.

15 Claims, 4 Drawing Sheets

(52) U.S. Cl.
CPC ... *F01L 2001/467* (2013.01); *F01L 2013/001* (2013.01); *F01L 2305/00* (2020.05)

(58) Field of Classification Search
USPC ..... 123/90.44
See application file for complete search history.

(56) References Cited

U.S. PATENT DOCUMENTS

2004/0074459 A1 4/2004 Hayman et al.
2005/0188930 A1* 9/2005 Best ..... F01L 1/181 123/90.16
2005/0247279 A1 11/2005 Rorig et al.
2008/0271693 A1* 11/2008 Edelmayer ..... F01L 1/22 123/90.44
2011/0005483 A1* 1/2011 Manther ..... F01L 13/0021 123/90.39
2011/0290206 A1* 12/2011 Meistrick ..... F01L 1/2411 123/90.46
2013/0061829 A1 3/2013 Yang et al.
2014/0182539 A1* 7/2014 Gron, Jr ..... F01L 13/0015 123/182.1
2017/0009610 A1* 1/2017 Ahmed ..... F01L 1/2405
2017/0145876 A1* 5/2017 Pham ..... F01L 13/0036
2017/0198610 A1* 7/2017 Haefner ..... F01L 13/0005
2017/0284313 A1* 10/2017 Shewell ..... F01L 1/2416
2020/0408113 A1 12/2020 Radulescu et al.
2021/0262366 A1 8/2021 Van Wingerden et al.

FOREIGN PATENT DOCUMENTS

WO WO-2004/053303 A1 6/2004
WO WO-2009/151352 A1 12/2009
WO WO-2019/092245 A1 5/2019

* cited by examiner

CENTER PIVOT LATCHED DEACTIVATING ROCKER ARM

This is a § 371 National Stage Entry of Application PCT/EP2019/025251 filed Jul. 26, 2019, which claims the benefit of U.S. provisional application No. 62/711,200 filed Jul. 27, 2018 and which claims the benefit of U.S. provisional application No. 62/841,175 filed Apr. 30, 3019, all of which are incorporated herein by reference.

FIELD

This application provides latched center pivot (type III) rocker arms that can switch between activated and deactivated configurations.

BACKGROUND

Center pivot rocker arms, also called "type III" rocker arms, comprise a cam interface at a cam end and a valve interface at a valve end. In-between, a rocker shaft bore can connect to pivot around a rocker shaft. Hence the name "center pivot." This type of rocker arm is popular in vehicles and it is desired to provide options that enable switching between variable valve actuation ("VVA") functions.

SUMMARY

The methods and devices disclosed herein improves the art by way of center pivot (type III) rocker arms that can switch between activated and deactivated configurations to enable switching between variable valve actuation ("VVA") functions. For example, in an activated configuration, the rocker arm can transfer a first valve lift profile to engine valves. In a deactivated configuration, the rocker arm can transfer a second valve lift profile. The second valve lift profile can be a zero lift profile, also known as a lost motion profile. The lost motion profile can facilitate, for example, cylinder deactivation ("CDA") engine operation.

A rocker arm can comprise a cam arm, a valve arm, a lost motion spring biasing them apart, and a latch assembly.

In a first instance, the rocker arm can comprise a cam arm comprising a cam interface at a first cam arm end, a spring pressing area at or near a second cam arm end, a cam arm body between the first cam arm end and the second cam arm end, and a pivot axle connection in the cam arm body. The valve arm can comprise a valve arm body. The valve arm body can comprise a rocker shaft bore, a latch socket, a pivot axle mounting area connected to the pivot axle connection by a pivot axle, and a lost motion spring mount. A valve arm neck can extend from the valve arm body. A head can be connected to the neck. The head can be configured to interface directly or indirectly with an engine valve. The lost motion spring can be biased between the lost motion spring mount and the spring pressing area. The latch assembly can be in the latch socket. The latch assembly can comprise a pair of deactivatable latches configured to protrude out of the latch socket in an activated configuration to impede travel of the cam arm with respect to the lost motion spring and configured to collapse into the latch socket in a deactivated configuration to enable the second cam arm end to act on the lost motion spring.

In a second instance, the rocker arm can comprise a cam arm comprising a cam interface at a first cam arm end, a spring pressing area at or near a second cam arm end, a cam arm body between the first cam arm end and the second cam arm end, and a pivot axle connection in the cam arm body. The valve arm can comprise a valve arm body. The valve arm body can comprise a rocker shaft bore, a pivot axle mounting area connected to the pivot axle connection by a pivot axle, and a lost motion spring mount. A valve arm neck can extend from the valve arm body. A latch socket can be in the valve arm neck. A head can be connected to the neck, the head configured to interface directly or indirectly with an engine valve. A lost motion spring can be biased between the lost motion spring mount toward the spring pressing area. The latch assembly can be in the latch socket. The latch assembly can comprise a deactivatable latch configured to protrude out of the latch socket in a first configuration to impede motion of the cam arm and configured to collapse in the latch socket in a second configuration so that the second cam arm end is movable to collapse the lost motion spring.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

It is to be understood that both the foregoing general description and the following detailed description are exemplary and explanatory only and are not restrictive of the claimed invention.

DETAILED DESCRIPTION

Reference will now be made in detail to the examples which are illustrated in the accompanying drawings. Wherever possible, the same reference numbers will be used throughout the drawings to refer to the same or like parts. Directional references such as "left" and "right" are for ease of reference to the figures.

Figures 1A, 1B, 1C:
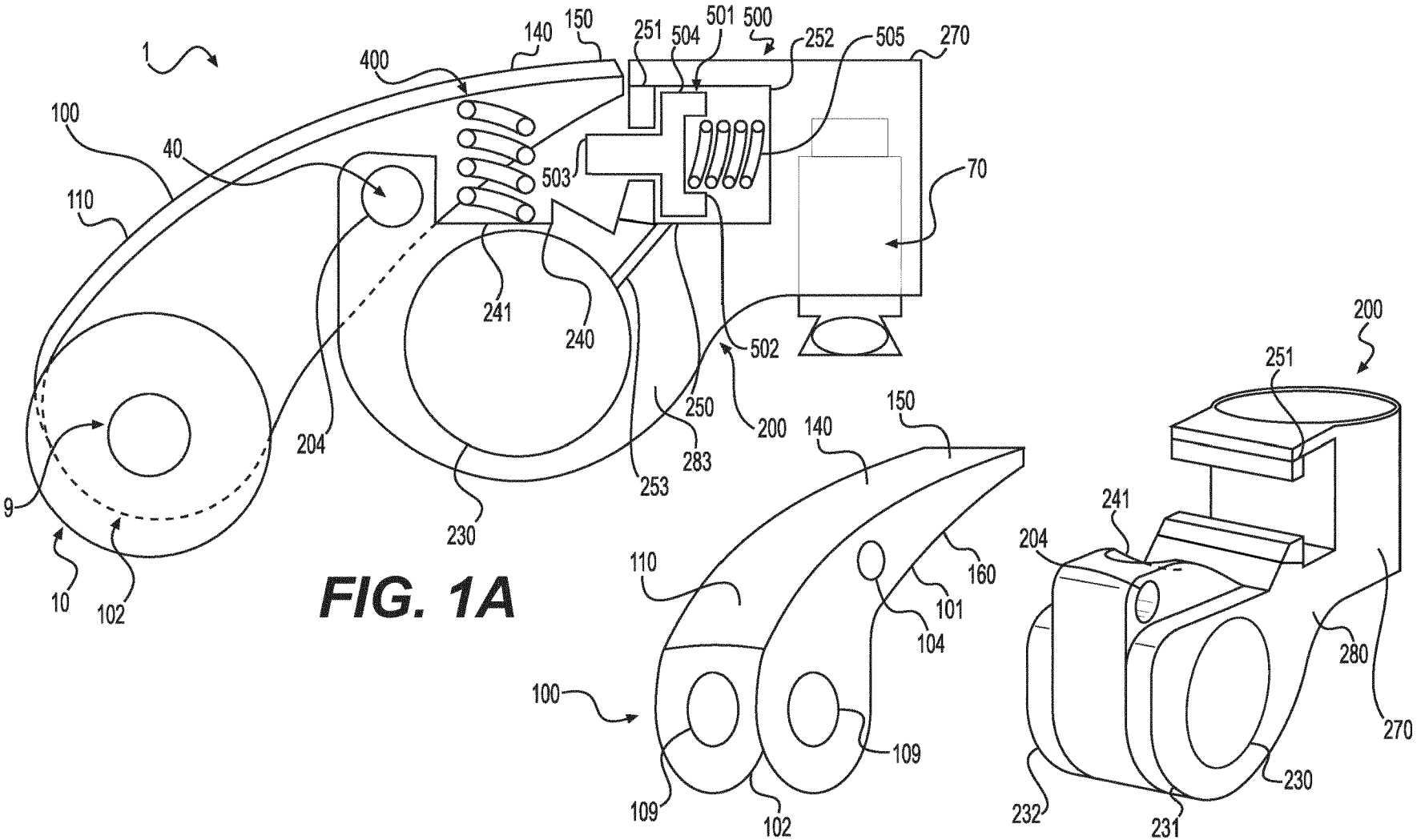
FIGS. 1A-1C show a first configuration of a rocker arm.
Figure 2B:
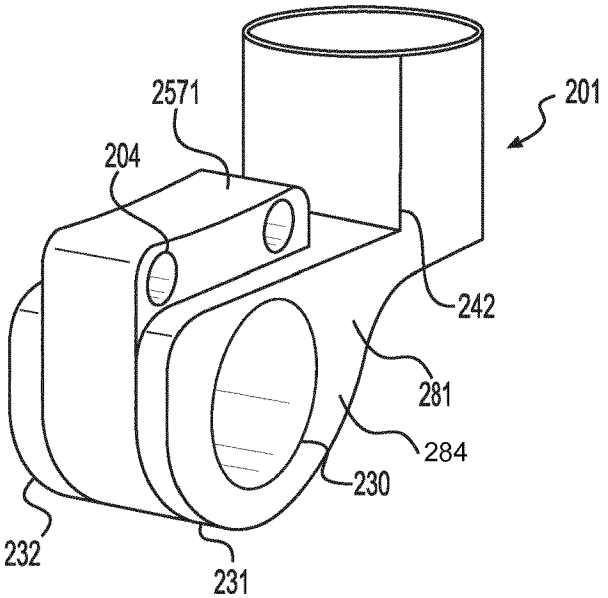
FIGS. 2A & 2B show a second rocker arm configuration.
Figure 2A:
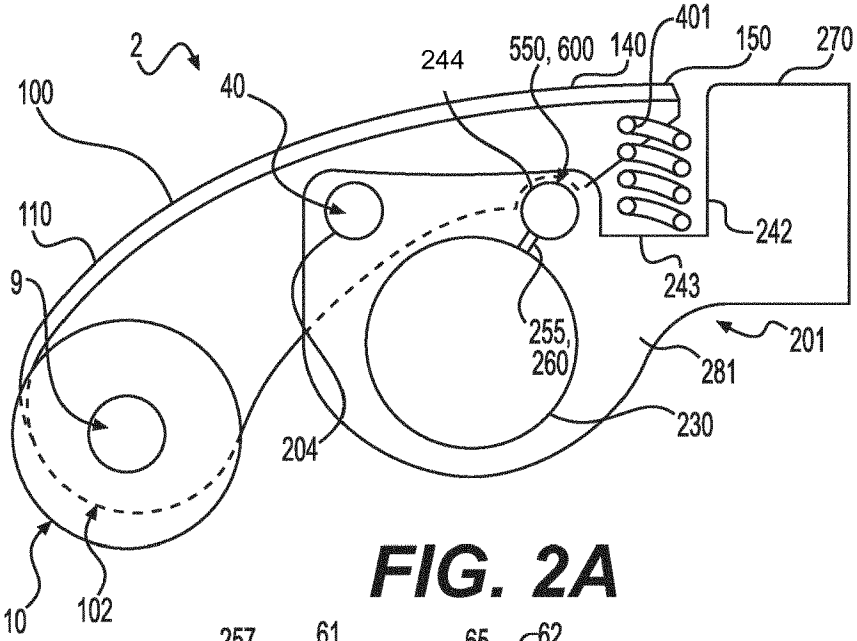

This application provides alternative deactivating rocker arms. FIGS. 1A & 2A provide alternative rocker arms comprising over-valve mechanical latch assemblies and a pivoting arm arrangement. These rocker arms comprise a midline bisecting the rocker shaft bore. It can be said that a pivot axle, a lost motion spring, and a latch socket are above the midline and a cam interface is below the midline. The latch assembly position can impact forces on the valve actuation.

Figure 5:
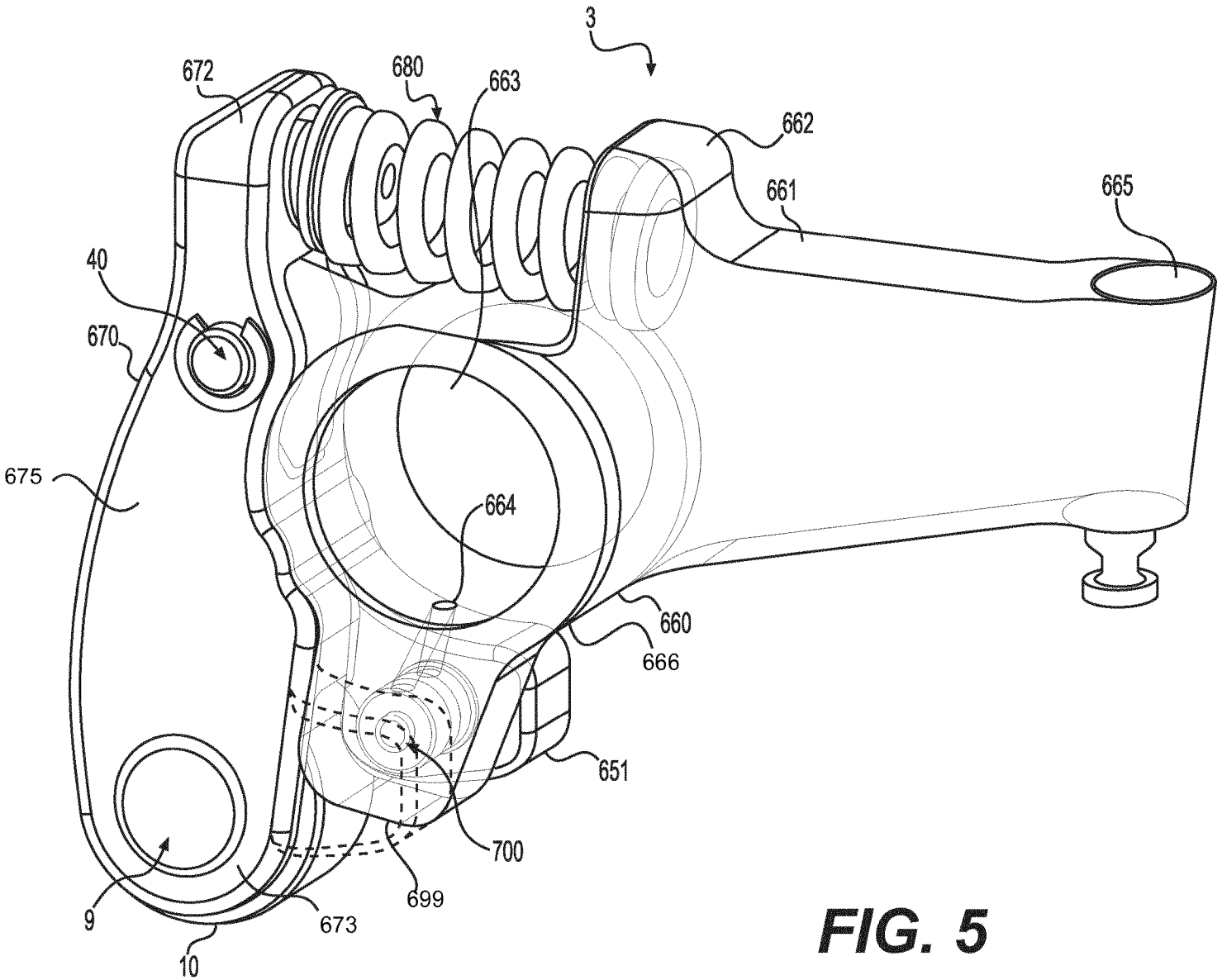
FIGS. 5 & 6 show a third rocker arm configuration.

FIG. 5 provides an alternative deactivating rocker arm. The pivoting arm arrangement comprises a midline bisecting the rocker shaft bore, wherein the pivot axle and the lost motion spring are above the midline and wherein the cam interface and the latch assembly are below the midline. In this configuration there can be provided a three point interaction between the location of the latch assembly, rocker shaft, and pivot axle that can be optimized to change the stress levels on the latch assembly.

In each of the figures, the lost motion spring 680, 400, 401 is between the pivot axle 40 and the head 665, 270. In FIG. 2A, the latch socket is between the lost motion spring 401 and the pivot axle 40. In FIG. 1, the lost motion spring 400 is between the latch socket and the pivot axle 40.

Returning to FIGS. 1A & 2A, a deactivating type III (center pivot) rocker arm can be comprised of two members, comprising a cam arm 100 and a valve arm 200, 201, and a mechanical latch assembly 500, 550, 600, 700. The cam arm 100 can be configured to pivot about a pivot axle 40 and to selectively transfer the motion of a cam to the valve arm 200 through the mechanical latch assembly 500, 550, 600. The rocker arm 1, 2 is capable of deactivating valve motion in a type III valvetrain.

The deactivating type III (center pivot) rocker arm 1, 2 can be comprised of two members, comprising a cam arm 100 and a valve arm 200, 201, and a mechanical latch assembly 500, 550, 600, 700. The first member can be the valve side arm 200, 201 featuring a pivot (usually a rocker shaft bore 230 for a rocker shaft), a mechanical latching assembly 500, 550, 600, 700 connecting the first member to the second member, and either an HLA 70 or mechanical lash adjustment screw that will interface with a valve or valve bridge. The second member can comprise or consist of cam arm 100. On a first cam arm end 102, a cam interface area can comprise a roller 10 and roller axle 9 for interfacing with a cam on a camshaft. A second cam arm end 150 of the cam arm 100 can comprise a latch interface for interfacing with a mechanical latch assembly. A pivot axle 40 can connect the first and second members allowing the second member to pivot in lost motion when the latch assembly of the first member is disengaged.

A lost motion spring 400, 401 can be configured to bias the two members apart from each other. The lost motion spring 400, 401 maintains dynamic control of the second member as it pivots about the pivot axle 40 when the mechanical latch assembly 500, 550, 600, 700 is disengaged.

The mechanical latch assembly, when engaged, translates the motion of the second member to the first member. When disengaged, the mechanical latch assembly is configured to allow the second member to move freely about the pivot axle 40. The latch assembly can be oriented in multiple ways according to FIGS. 1A, 2A, 3, 4, & 6 and can be hydraulically or mechanically actuated to switch between an activated configuration (engaged) and a deactivated configuration (disengaged).

Figure 6:
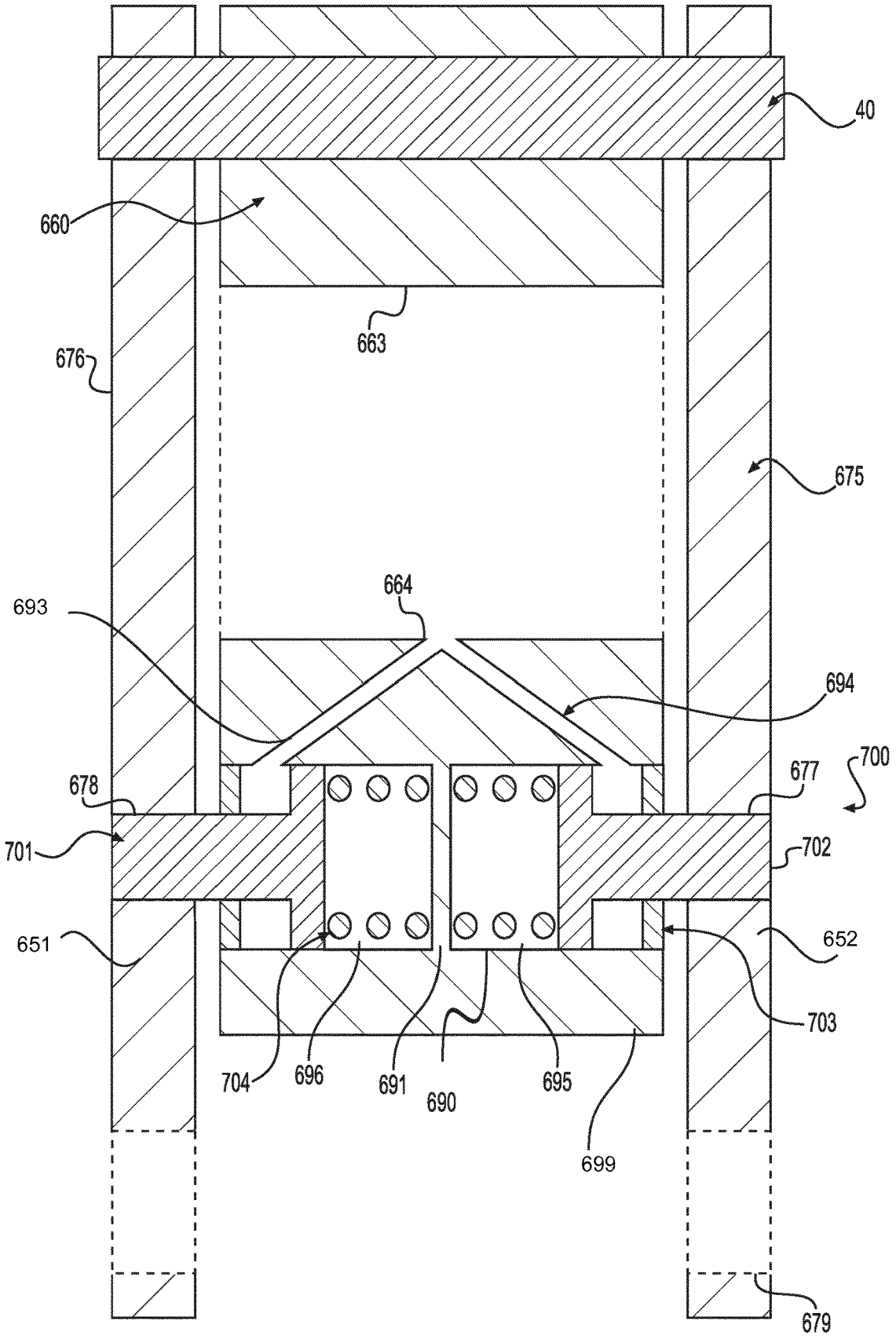

In FIGS. 2A & 6, a dual latch configuration is shown for the type III deactivating rocker arm. So, the rocker arms 1, 2, 3, can be cylinder deactivation ("CDA") rocker arms for a Type III (center pivot) valvetrain. Whereas a single latch pin (deactivatable latch 501) can have high contact stresses where the latch pin and rocker arm body meet, it can be possible to spread the load over two latch pins (deactivatable latches 66 or 91 or 701, 702) to reduce the contact stresses significantly. Locating the two deactivatable latches 66, 91 or 701, 702 to collapse inward near the roller axle 9 requires two oil ports 693, 694 within the valve arm body 666. The two oil ports 693, 694 can originate from the rocker shaft bore 663 at a central hole 664 and branch within the rocker arm body.

A deactivating center pivot rocker arm 1, 2 can comprise a valve arm 200, 201 comprising a pivot such as a rocker shaft bore 230, a mechanical latching mechanism such as one of latch assemblies 500, 550, 600, 700, and either an HLA 70 or mechanical lash adjustment screw configured to interface with a valve or a valve bridge such as through an elephant foot (e-foot) extending from the head 270 of the valve arm 200, 201. A second member comprises a cam arm 100. Such cam arm 100 can comprise a roller 10 and a roller axle 9 for interfacing with a camshaft. A second cam arm end 150 can form a latch interface such as a ledge for interfacing with the mechanical latch in the form of latch assembly 500. The mechanical latch in the form of mechanical latch assembly 500 selectively mechanically connects the first member to the second member as by the ledge pressing on the protruding deactivatable latch 501. In an alternative, second cam arm end 150 comprises extensions 160 to mechanically connect the first member to the second member, as by extensions 160 pressing on protruding deactivatable latches 66, 91, 701, 702.

A pivot axle 40 can connect the first and second members such that the second member pivots in lost motion when the deactivatable latch mechanism(s) of the first member is disengaged and collapsed into a latch socket in a deactivated configuration.

A lost motion spring 400, 401 can be configured to bias the first and second members apart from each other. The lost motion spring maintains dynamic control of the second member as it pivots about the pivot axle 40 when the mechanical latch assembly is disengaged. The mechanical latch assembly 500, 550, 600, 700, when engaged in an activated configuration, translates the motion of the second member to the first member. When the mechanical latch assembly is disengaged, the mechanical latch assembly is configured to allow the second member to move freely about the pivot axle 40. In some configurations, the pivot axle can be omitted, and the pivot can be freely about the rocker shaft bore 230 as by extending a portion of the cam arm body 110 to wrap around the rocker shaft bore 230. The pivot comprises the rocker shaft bore.

The mechanical latch assemblies 500, 550, 600, 700 are shown as hydraulically actuated, but can alternatively be mechanically actuated to switch between an engaged position (activated configuration) and a disengaged position (deactivated configuration).

A rocker arm for a type III valvetrain can alternatively comprise a cam arm 670 comprising a first cam arm end 673 comprising a cam interface such as a roller 10 on a roller axle 9. The roller axle 9 can be mounted in bores 679 in the first cam arm end 673. A roller bearing 10 can be mounted on the roller axle 9 in the bores 679 between the first and second segments 675, 676. A second cam arm end 672 can comprise a spring pressing area in the form of a socket for mounting a lost motion spring 680. A cam arm body 670 can be hollow to comprise first and second segments extending therefrom. The first and second segments can comprise first and second latch extension 651, 652. Second latch extension 652 is shown in broken lines in FIG. 5. The first and second segments can comprise the bores 679. The first and second segments 675, 676 can comprise pivot axle connections for receiving pivot axle 40. Pivot axle 40 can be retained by clips, for example. Latch extensions 651, 652 can comprise opposed first and second latch ports 677, 678.

A valve arm 660 can comprise a lost motion spring mount 662 in the form of a second socket in valve arm body 666. A 663 rocker shaft bore can be formed so that a branched oil feed extends from the rocker shaft bore 663 to the latch socket 690. The oil feed comprising a first oil branch forming oil port 693 and a second oil branch forming oil port 694, the oil ports spreading from a central hole 664. A latch assembly 700 can be configured in the latch socket 690.

The latch socket 690 can comprise a center wall 691 dividing the latch socket into a first half 696 and a second half 695. The latch assembly 700 comprises a pair of return springs 704 biased against respective sides of the center wall 691. The pair of return springs bias the pair of deactivatable latches 701, 702 apart so that the latches protrude out through first and second latch ports 677, 678 when in the activated configuration. To switch the rocker arm to a second configuration comprising a deactivated configuration, the at least one oil port comprising the pair of oil ports 693, 694 supplies pressurized oil to the divided latch socket to collapse the pair of deactivatable latches. The divided latch socket can comprise plugs 703 so that first and second plugs surround the first and second deactivatable latches 701, 702. The plugs 703 can seat in the latch socket 690 to fluid seal the deactivatable latches and the latch socket 690.

The rocker arm 2, 3 can comprise a cam arm 100, 670 comprising a cam interface at a first cam arm end 102, 673. Cam interface can be a tappet or roller bearing 10. A spring pressing area 140 at or near a second cam arm end 150, 672, a cam arm body 110 between the first cam arm end 102, 673 and the second cam arm end 150, 672, and a pivot axle connection 104 in the cam arm body 110. The valve arm 201, 660 can comprise a valve arm body 284, 666. The valve arm body 284, 666 can comprise a rocker shaft bore 230, 663, a latch socket 244, 690, a pivot axle mounting area 204 connected to the pivot axle connection 104 by a pivot axle 40, and a lost motion spring mount 243, 662 such as a socket. A valve arm neck 281, 661 can extend from the valve arm body 284, 666. A head 270, 665 can be connected to the valve arm neck 281, 661. The head 270, 665 can be configured to interface directly or indirectly with an engine valve as by an e-foot or valve bridge, a capsule, or the like. The lost motion spring 401, 680 can be biased between the lost motion spring mount 243, 662 and the spring pressing area 140. The latch assembly 550, 600, 700 can be in the latch socket 244, 690. The latch assembly can comprise a pair of deactivatable latches 66, 91, or 701, 702 configured to protrude out of the latch socket 244, 690 in an activated configuration to impede travel of the cam arm 100, 670 with respect to the lost motion spring 401, 680 and configured to collapse into the latch socket in a deactivated configuration to enable the second cam arm end 150, 672 to act on the lost motion spring 401, 680. The cam arm 100 can collapse the lost motion spring 401. It is possible to collapse or scissor apart the lost motion spring 680.

At least one oil port 253, 260, 255, 664 extends from the rocker shaft bore, 230, 663. The at least one oil port is connected to the latch socket 252, 244, 690 to configure the deactivatable latches 66, 91, or 701, 702 in one of the activated configuration or the deactivated configuration.

Figure 3:
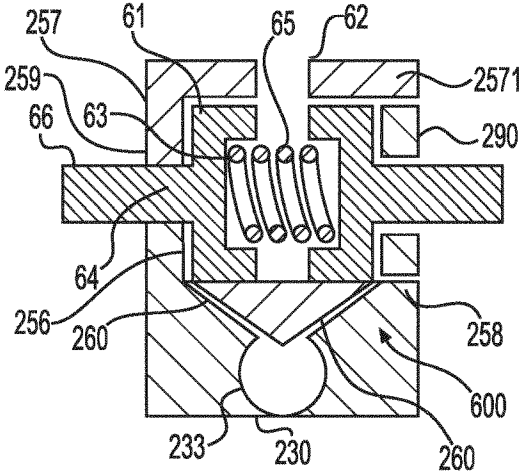

In FIG. 3, the latch assembly 600 comprises a center spring 65 biasing the pair of deactivatable latches 66 apart. The at least one oil port comprises a pair of oil ports 260 configured to supply pressurized oil to collapse the pair of deactivatable latches 66 into the latch socket by compressing the center spring 65. Each deactivatable latch 66 can comprise a spring cup 63, a seat portion 61, and a latch pin 64. Pressurized oil to gland 233 from rocker shaft bore 230 travels the oil ports 260. The pressure pushes the seat portions 61 to slide in the cavity 256 and collapse the center spring 65. The timing of the deactivation can be controlled by including a controlled oil port 62 out of the latch socket. A size of the controlled oil port 62 controls how fast and in what latch position oil can leak out and depressurize the deactivatable latches 66 to return to their protruding positions, as biased by the center spring 65. The latch socket can comprise a retention wall 2571 and the controlled oil port 62 can be through the retention wall 2571.

The latch socket can comprise a latch port 259 on a first side 257 configured so that a first one of the pair of deactivatable latches protrudes out of the valve body. The latch socket can comprise a plug 290 on a second side 258 configured so that a second one of the pair of deactivatable latches protrudes out of the valve body.

The rocker arms can alternatively comprise a latch assembly 700 of FIGS. 5 & 6, meaning that any of rocker arms 2 & 3 can comprise any one of the dual latch assemblies 550, 600, 700. The latch socket 690 can comprise a center wall 691 dividing the latch socket 690. The latch assembly 700 can comprise a pair of return springs 704 biased against respective sides of the center wall 691, the pair of return springs 704 biasing the pair of deactivatable latches 701, 702 apart. The at least one oil port comprises a pair of oil ports 693, 694 configured to supply pressurized oil to the divided latch socket to collapse the pair of deactivatable latches 701, 702. The latch socket 690 can comprise a first latch plug 703 on a first side configured so that a first one 701 of the pair of deactivatable latches protrudes out of the valve arm body 666. The latch socket can comprise a second latch plug 703 on a second side configured so that a second one 702 of the pair of deactivatable latches protrudes out of the valve arm body 666. The valve body can comprise a latch extension 699 to position the latch assembly 700 below the midline of the rocker arm and adjacent the cam interface. In this configuration there can be provided a three point interaction between the location of the latch assembly 700, rocker shaft in rocker shaft bore 663, and pivot axle 40 that can be optimized to change the stress levels on the latch assembly 700.

Figure 4:
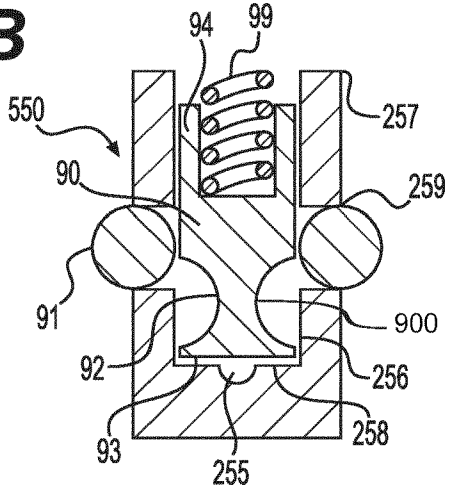
FIGS. 3 & 4 show alternative latch assemblies.

Turning to FIG. 4, the latch assembly 550 comprises an alternative configuration. The latch socket comprises a first latch port 259 on a first side configured so that a first one of the pair of deactivatable latches 91 protrudes out of the valve body. The latch socket comprises a second latch port 259 on a second side configured so that a second one of the pair of deactivatable latches 91 protrudes out of the valve body. A movable member 900 reciprocates in the latch socket cavity 258 between a top half 257 of the latch socket and a bottom half 256. The movable member 900 comprises a member body 90 and a pair of latch grooves 92 connected to the member body 90. A member return spring 99 is biased between a the movable member 900 and the cam arm body 110. The member return spring 99 can be secured in a spring cup 94 or, like the lost motion springs 400, 401, 680, the member return spring 99 can be secured by another mounting feature, such as a peg, socket, lip, or groove or the like. The movable member 900 is controllable to align the member body 90 to protrude the pair of deactivatable latches 91 out of the latch socket in the activated configuration and movable member 900 is controllable to align the pair of latch grooves 92 to collapse the pair of deactivatable latches 91 into the latch socket. With the latch grooves 92 aligned with the deactivatable latches 91, when the extensions 160 of the cam arm press down from forces received at the cam interface, the extensions 160 push the balls or other shaped chits into the latch grooves 92. Controlling the pressure of spring 99 and oil pressure to oil port 255 controls the movable member 900. Oil pressure to base 93 lifts the movable member 900, while the return spring 99 can push the movable member 900 in the absence of oil pressure. Assistance from cam arm 100 pushing on return spring or spring cup 94 is also possible.

So, it can be said that the rocker arm can comprises an one oil port 255 extending from the rocker shaft bore 230, 663, the at least one oil port 255 connected to the latch socket to control the movable member 900 to configure the deactivatable latches 91 in one of the activated configuration or the deactivated configuration.

In FIG. 1A, the rocker arm 1 can comprise a cam arm 100 comprising a cam interface at a first cam arm end 102, a spring pressing area 140 at or near a second cam arm end 150, a cam arm body 110 between the first cam arm end 102 and the second cam arm end 150, and a pivot axle connection 104 in the cam arm body 110. The valve arm 200 can comprise a valve arm body 283. The valve arm body 283 can comprise a rocker shaft bore 230, a pivot axle mounting area 204 connected to the pivot axle connection 104 by a pivot axle 40, and a lost motion spring mount 241. The lost motion spring mount 241 can comprise a socket or the like. A valve arm neck 280 can extend from the valve arm body 283. A latch socket 252 can be in the valve arm neck 280. A head 270 can be connected to the neck 280, the head 270 configured to interface directly or indirectly with an engine valve. A lost motion spring 400 can be biased between the lost motion spring mount 241 toward the spring pressing area 140. The latch assembly 500 can be in the latch socket 252. The latch assembly 500 can comprise a deactivatable latch 501 configured to protrude out of the latch socket 252 in a first configuration to impede motion of the cam arm 100 and configured to collapse in the latch socket 252 in a second configuration so that the second cam arm end 150 is movable to collapse the lost motion spring 400.

The latch assembly 500 can comprise the deactivatable latch 501 biased to protrude by a return spring 505 at a spring mount such as spring cup 504. The deactivatable latch 501 can be held in the latch socket cavity 252 by a frit or plug 251. The spring cup 504 can form a seal against a wall 250 of the cavity 252 so that the deactivatable latch 501 can slide against the wall 250 when pressurized oil is supplied by oil port 253. Additional walls can be included to encase the latch assembly 500 in the latch socket. A latch pin 503 of deactivatable latch 501 can restrict a ledge on second cam arm end 150 when it protrudes, and the ledge can pass the latch pin 503 when the oil pressure collapses the deactivatable latch 501 in the latch socket.

Other implementations will be apparent to those skilled in the art from consideration of the specification and practice of the examples disclosed herein.

What is claimed is:

1. A rocker arm, comprising:
- a cam arm, comprising:
  - a cam interface at a first cam arm end;
  - a spring pressing area at a second cam arm end;
  - a cam arm body between the first cam arm end and the second cam arm end; and
  - a pivot axle connection in the cam arm body;
- a valve arm, comprising:
  - a valve arm body, comprising:
    - a rocker shaft bore;
    - a latch socket;
    - a pivot axle mounting area connected to the pivot axle connection via a pivot axle; and
    - a lost motion spring mount;
  - a valve arm neck extending from the valve arm body; and
  - a head connected to the valve arm neck, the head configured to interface with an engine valve;
- a lost motion spring pressed between the lost motion spring mount and the spring pressing area; and
- a latch assembly in the latch socket, the latch assembly comprising a pair of deactivatable latches configured to:
  - in an activated configuration, protrude out of the latch socket so as to impede travel of the cam arm with respect to the lost motion spring, and
  - in a deactivated configuration, collapse into the latch socket so as to enable the second cam arm end to act on the lost motion spring,
- wherein the lost motion spring is positioned between the pivot axle and the head, and
- wherein the latch socket is between the lost motion spring and the pivot axle.

2. The rocker arm of claim 1, further comprising at least one oil port extending from the rocker shaft bore to the latch socket, the at least one oil port configured to supply pressurized oil to the latch socket.

3. The rocker arm of claim 2, wherein the latch assembly further comprises a center spring biasing the pair of deactivatable latches apart, wherein the at least one oil port comprises a pair of oil ports configured to respectively supply the pressurized oil to the pair of deactivatable latches so as to compress the center spring when in the deactivated configuration.

4. The rocker arm of claim 3, wherein the latch socket comprises a controlled oil port configured to vent the pressurized oil out of the latch socket.

5. The rocker arm of claim 1, wherein, when in the activated configuration, a first latch of the pair of deactivatable latches protrudes out of a latch port arranged on a first side of the latch socket, and a second latch of the pair of deactivatable latches protrudes out of a plug arranged on a second side of the latch socket.

6. The rocker arm of claim 2, wherein the latch socket comprises a center wall dividing the latch socket, wherein the latch assembly further comprises a pair of return springs biased against respective sides of the center wall, the pair of return springs respectively biasing the pair of deactivatable latches apart, wherein the at least one oil port comprises a pair of oil ports configured to respectively supply the pressurized oil to the pair of deactivatable latches so as to compress the pair of return springs when in the deactivated configuration.

7. The rocker arm of claim 1, wherein, when in the activated configuration, a first latch of the pair of deactivatable latches protrudes out of a first latch plug arranged on a first side of the latch socket, and a second latch of the pair of deactivatable latches protrudes out of a second latch plug arranged on a second side of the latch socket.

8. The rocker arm of claim 1, further comprising a midline bisecting the rocker shaft bore, wherein the pivot axle, the lost motion spring, and the latch socket are positioned above the midline and wherein the cam interface is positioned below the midline.

9. A rocker arm, comprising:
- a cam arm, comprising:
  - a cam interface at a first cam arm end;
  - a spring pressing area at a second cam arm end;
  - a cam arm body between the first cam arm end and the second cam arm end; and
  - a pivot axle connection in the cam arm body;
- a valve arm, comprising:
  - a valve arm body, comprising:
    - a rocker shaft bore;
    - a latch socket comprising a first side including a first latch port, and a second side including a second latch port;
    - a pivot axle mounting area connected to the pivot axle connection via a pivot axle; and
    - a lost motion spring mount;
  - a valve arm neck extending from the valve arm body; and
  - a head connected to the valve arm neck, the head configured to interface with an engine valve;
- a lost motion spring pressed between the lost motion spring mount and the spring pressing area; and
- a latch assembly in the latch socket, the latch assembly comprising:

a pair of deactivatable latches configured to, in an activated configuration, respectively protrude out of the first latch port and the second latch port so as to impede travel of the cam arm with respect to the lost motion spring and, in a deactivated configuration, collapse into the latch socket so as to enable the second cam arm end to act on the lost motion spring;

a movable member comprising a member body and a pair of latch grooves connected to the member body; and a member return spring pressed between the movable member and the cam arm body, wherein the movable member is controlled such that the member body engages the pair of deactivatable latches when in the activated configuration, and the pair of latch grooves respectively engage the pair of deactivatable latches when in the deactivated configuration.

10. The rocker arm of claim 9, further comprising at least one oil port extending from the rocker shaft bore to the latch socket, the at least one oil port configured to supply pressurized oil to the latch socket.

11. The rocker arm of claim 9, wherein the lost motion spring is positioned between the pivot axle and the head.

12. The rocker arm of claim 11, wherein the latch socket is positioned between the lost motion spring and the pivot axle.

13. A rocker arm, comprising:

a cam arm, comprising:

a cam interface at a first cam arm end;

a spring pressing area at a second cam arm end;

a cam arm body between the first cam arm end and the second cam arm end; and a pivot axle connection in the cam arm body;

a valve arm, comprising:

a valve arm body, comprising:

a rocker shaft bore;

a latch socket;

a pivot axle mounting area connected to the pivot axle connection via a pivot axle; and a lost motion spring mount;

a valve arm neck extending from the valve arm body; and a head connected to the valve arm neck, the head configured to interface with an engine valve;

a lost motion spring pressed between the lost motion spring mount and the spring pressing area; and a latch assembly in the latch socket, the latch assembly comprising a pair of deactivatable latches configured to:

in an activated configuration, protrude out of the latch socket so as to impede travel of the cam arm with respect to the lost motion spring, and in a deactivated configuration, collapse into the latch socket so as to enable the second cam arm end to act on the lost motion spring; and a midline bisecting the rocker shaft bore, wherein the pivot axle and the lost motion spring are positioned above the midline, and wherein the cam interface and the latch assembly are positioned below the midline.

14. A rocker arm, comprising:

a cam arm, comprising:

a cam interface at a first cam arm end;

a spring pressing area at a second cam arm end;

a cam arm body between the first cam arm end and the second cam arm end; and a pivot axle connection in the cam arm body;

a valve arm, comprising:

a valve arm body, comprising:

a rocker shaft bore;

a pivot axle mounting area connected to the pivot axle connection via a pivot axle; and a lost motion spring mount;

a valve arm neck extending from the valve arm body;

a latch socket in the valve arm neck; and a head connected to the valve arm neck, the head configured to interface with an engine valve;

a lost motion spring pressed between the lost motion spring mount and the spring pressing area; and a latch assembly in the latch socket, the latch assembly comprising a deactivatable latch configured to:

in a first configuration, protrude out of the latch socket so as to impede motion of the cam arm with respect to the lost motion spring, and in a second configuration, collapse into the latch socket so as to enable the second cam arm end to compress the lost motion spring.

15. The rocker arm of claim 14, wherein the lost motion spring is positioned between the latch socket and the pivot axle.

* * * * *